United States Patent [19]

Scholl et al.

[11] 4,134,210

[45] Jan. 16, 1979

[54] GUIDE TEMPLATE FOR SEWING MACHINES

[75] Inventors: Hans Scholl, Oerlinghausen-Lippereihe; Horst Bernewasser, Steinhagen, both of Fed. Rep. of Germany

[73] Assignee: Kochs Adler AG, Bielefeld, Fed. Rep. of Germany

[21] Appl. No.: 826,075

[22] Filed: Aug. 19, 1977

[51] Int. Cl.[2] ..... B43L 13/00; D05B 21/00

[52] U.S. Cl. ..... 33/23 H; 74/568 R; 112/121.15

[58] Field of Search ..... 112/121.15, 121.11, 112/121.12, 102, 136, 153; 74/568 R; 33/27 K, 23 K, 23 H

[56] References Cited

U.S. PATENT DOCUMENTS

| | | | |
|---|---|---|---|
| 3,190,142 | 6/1965 | Bergonzo | 74/568 |
| 3,338,112 | 8/1967 | Holmes | 74/568 |
| 3,774,558 | 11/1973 | Scholl et al. | 74/568 X |

*Primary Examiner*—H. Hampton Hunter

*Attorney, Agent, or Firm*—Max Fogiel

[57] ABSTRACT

A guide template for sewing machines in which a driven roller follows along the template's contour to sew workpieces of different form and/or size. The template has a number of sections which are movable relative to one another. For purposes of lengthening one of these template sections, a second movable and adjustable template section is provided in combination with a third template section which is pivotably mounted on the second template section. The third template section may be adjusted to different contours by an adjustment device. This adjustment device has a cam plate interacting with the third template section, and mounted rotatably on the machine frame through the use of a handwheel. The second template section is located between the first and third template sections, and is used to extend the template. The second template section is held by a gear rack on a plate on the machine frame, and the gear rack engages a pinion which is rotatable with an adjustment knob for shifting on the gear rack. The plate holding the gear rack has slotted holes for shifting the gear rack and the second template section.

6 Claims, 8 Drawing Figures

IV
IV
III
III

GUIDE TEMPLATE FOR SEWING MACHINES

BACKGROUND OF THE INVENTION

The present invention relates to a guide template for a sewing machine moving along its contour by means of a driven roller, to sew workpieces of different form and/or size. The template has a number of sections which can be moved relative to each other.

It is the purpose of the present invention to limit the number of guide templates required in contour sewing machines for moving the workpiece relative to the stitch plate for sewing workpieces of different size and/or shape to a small number.

With a guide template known from U.S. Pat. No. 3,216,380 of the above type, there is a number of overlapping template sections which are moved by means of a spindle and a handwheel lengthwise relative to one another, in order to produce workpieces of the same shape, but different length, avoiding the interchange of templates; with one seam according to the contour of the control template.

Similar control templates are discussed in a sewing device, having a rotary table and described in U.S. Pat. No. 3,407,759. With this known arrangement, guide templates located at the periphery, having several sections and overlapping in two planes may be reset for this magnetic roller travelling along it by means of a central adjusting device for workpieces of different length, but identical shape.

While these known guide templates can be adjusted only for workpieces of different lengths, U.S. Pat. No. 3,433,091 describes a template where only the shape can be varied. This comprises a rigid support and a large number of slot bolts movable for adjustment in one or two rows and located close to one another in the support, with the heads of the bolts forming the running surface for the roller.

U.S. Pat. No. 3,774,558 describes an adjustable template for use in a sewing device used for sewing of workpieces of different shape and different sizes. It has two base plates which can be moved relative to each other and on which a large number of segments with oblong holes can be moved and set. They have face surface ends abutting without steps to form an uninterrupted track for a magnetic roller. While the shape adjustment can be made of shifting the segments which taper rearward starting with the face surface, a rail connecting the segments on each of the movable base plates makes possible the setting for the various lengths.

With these known guide templates, a change in shape and even a change in shape and length is possible. However, both designs require a longer change-over period because of the cumbersome adjustment of the bolts and the shifting of the segments; therefore they are suitable mainly for sewing arrangements where there is no frequent change of the workpiece shape, as for example, in the making of cuffs or collars for shirts. In addition, the desired shape can be adjusted without the use of an adjustment template adapted to the seam contour.

High-grade garments, e.g., men's formal jackets, are produced in a large variety of standard sizes, retaining the basic shape, with the various sizes occurring in rather large numbers. The overall appearance of a jacket depends mainly on the shape of the lapels of the two front sections. The sewing of the lapels along the edges of the front section requires a skilled worker.

It is, therefore, an object of the present invention to provide a guide template of the above type which makes it possible, while maintaining a fixed shape of a garment, for an unskilled worker to adjust without much loss of time, these parts of the template to any size of the garment in any sequence so that there is obtained the guide template required for a certain workpiece size for determining the seam contour.

Another object of the present invention is to provide an arrangement, of the foregoing character, which is substantially simple in construction and may be economically fabricated.

A further object of the present invention is to provide an arrangement, as described, which may be easily maintained in service and which has a substantially long operating life.

SUMMARY OF THE INVENTION

The objects of the present invention are achieved by providing that on a movable and adjustable template section, to lengthen a first template section, a third template section is pivotably mounted and adjustable by means of an adjustment device to different contours.

The adjustments device for the template, adjustable to different contours, may have a cam plate interacting with it which is mounted rotatably by means of a handwheel on the machine frame.

The template portion between the first template section and the template portion adjustable for different contour, used to extend the template, is connected to a gear rack located on the machine frame. It meshes with a gear pinion, which is driven by a handwheel, in order to shift the template section on the gear rack.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompany drawings.

DESCRIPTION OF THE PREFERRED EMBODIMENTS

Figures 1, 2, 3, 4:
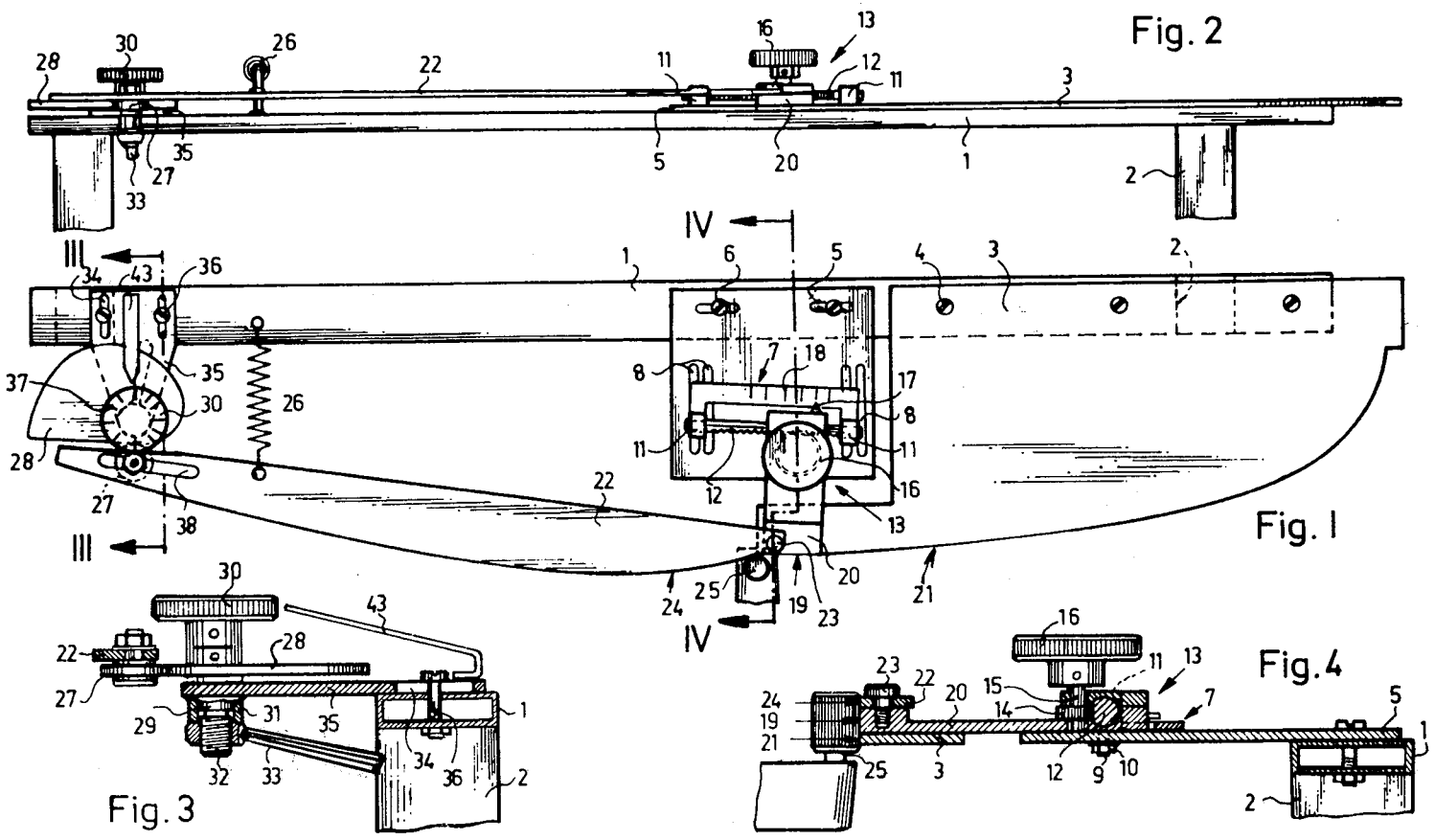
FIG. 1 is a top view of a multi-section adjustable guide template, inserted in a sewing arrangement for sewing the lapel of men's jackets.
FIG. 2 is a front view of the guide template.
FIG. 3 is a section taken along line III—III of FIG. 1.
FIG. 4 is a section taken along line IV—IV of FIG. 1.

On a carrier 1 of frame 2 mounting a sewing machine (not shown) a first template section 3 is fastened with screws 4 (FIG. 1). On a plate 5, connected lengthwise movably with carrier 1 by screws 6, is a U-shaped support section 7 fastened movably in slotted holes 8. For this purpose it is provided with threaded bolts 9 (FIG. 4) which project through the slotted holes 8 and on which nuts are threaded. The support section 7 has eyes 11 in which a gear rack 12 is mounted to accommodate a sliding section 13. By means of a gear pinion 14 (FIG. 4) engaged to gear rack 12, the pinion mounted on a shaft 15, and an adjusting knob 16, the sliding section 13 can be moved on the gear rack 12. Its position is indicated by a pointer 17 on the sliding section 13 and markings on the support section 7 which are by jacket size. The face surface 19 of the template section 20 movably contacting template section 3 is in line with the face surface 21 of template section 3.

A third template section 22 is mounted on template section 20 by means of a collar screw 23 to rotate on template section 20. In the area of the collar screw 23, the face surface 24 of the third template section 22 is in line with face surfaces 19 and 21 of template section 20 or the first template section 3, so that a driven magnetic roller 25 (FIG. 1) which moves the sewing machine (not shown) can roll without steps from one template section to the template section in another plane.

The third template section 22 is pressed on its free end by means of a tension spring 26 and via a loose roller 27, to a cam plate 28. The latter is mounted on a bearing trunnion 29 which is mounted via a handwheel 30 in a bushing 31, and has a threaded plane 32 (FIG. 3). On it is mounted a clamping lever 33 used for tightening the cam plate 28 after it has been set to a certain size of workpiece. The bushing 31 is inserted in a plate 35 (FIGS. 1 and 3) with slotted holes 34; this plate is movable and is fastened to carrier 1 with screws 36. By means of an index mark 43 attached to plate 35, and markings 37 on handwheel 30, the third template section 22 can be set to the contour required for the size wanted. The loose roller 27 is movable and can be fixed in a slotted hole 38 located in the third template section 22.

Figure 8:
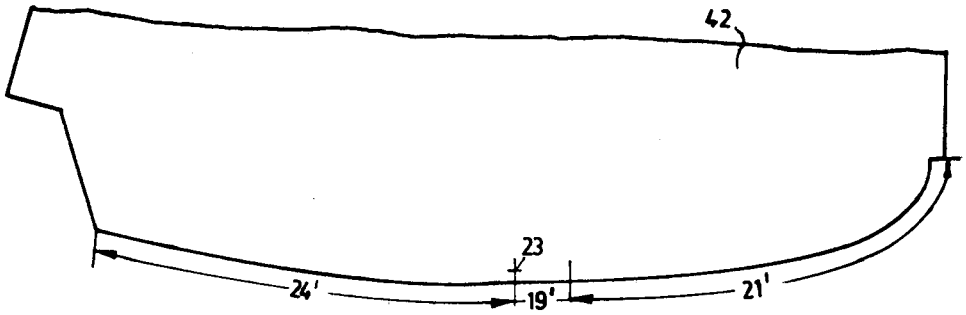
FIGS. 5 to 8 are front sections of men's formal jackets of different size, but same basic shape, which can be processed by merely adjusting the template sections with the guide template shown in FIGS. 1 to 4.
Figure 5:
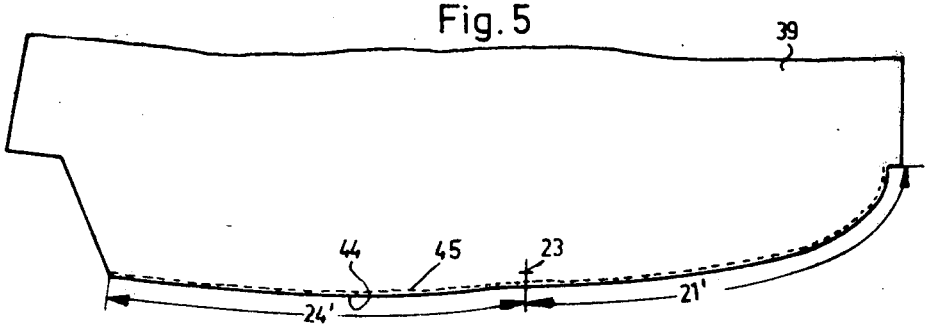

The jacket front parts in FIGS. 5 and 8, in accordance with the body sizes intended, have a seam 45 parallel to the front edge 45. Maintaining the same model, in accordance with the 50 standard sizes in a size table, the front edge and hence also the seams to be sewn have varying lengths and/or they must have a different contour.

The adjustment of the guide template can be described as follows:

With a front section 39 according to FIG. 5, the front edge 44 has two partical curves denoted by 21' and 24'. This template shape corresponds to the setting shown in FIG. 1, where only the first template section 3 with the face surface 21 and the third template section 22 with its face surface 24 come into play, while the face surface 19 of the template section 20, located along its entire length above the first template section 3, is ineffective.

Figure 6:
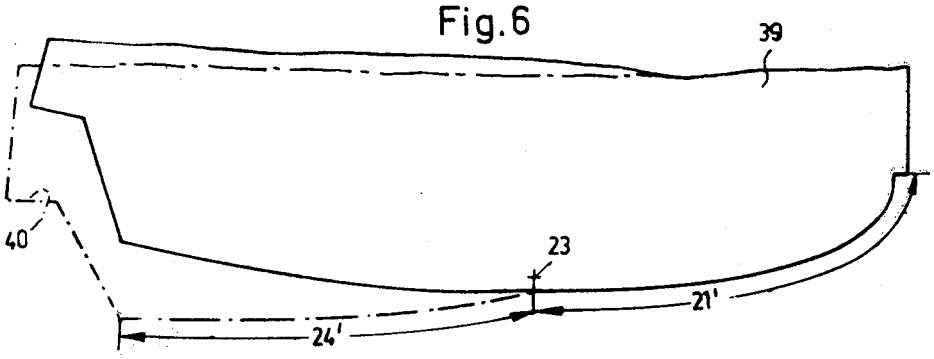

If, by rotating the cam plate 28 by means of handwheel 30, the third template section 22 (FIG. 1) is pivoted about the collar screw 23, there results the jacket front portion 39 shown in FIG. 6 with a dot-dash line changed shape 40.

Figure 7:
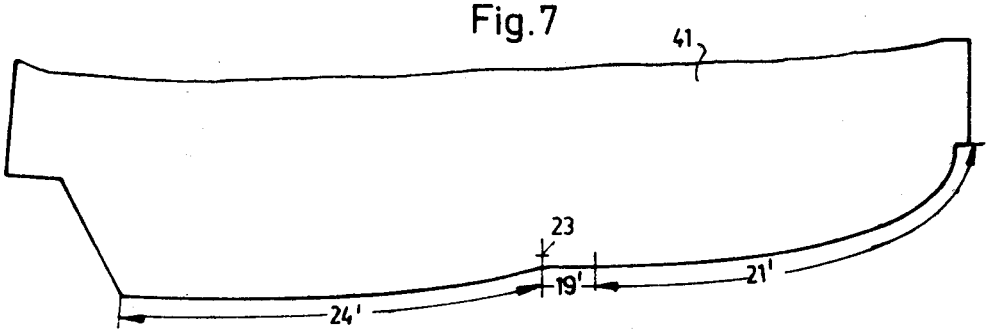

By displacing the moving section 13 (FIG. 1) on the gear rack 12 by means of the adjustment knob 16, the face surface 19 of template section 20 becomes effective, in order, as shown in FIG. 7, to add a partial contour 19' to partial contours 21' and 24', so that a longer jacket front portion 41 corresponding to the front portion 40 (FIG. 6) can be processed.

A front portion 42 drawn in FIG. 8 can be processed after suitable adjustment of handwheel 30 and hence of cam plate 28.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A guide template for a sewing machine for sewing workpieces of different form and/or size, comprising:
   - a machine frame,
   - a first template section,
   - a gear rack on a plate,
   - a third adjustable template section,
   - a second template section located between said first template section and said third template section, for extending the guide template, and held by said gear rack on said plate on said machine frame, and
   - pinion means with an adjusting knob, said pinion means engaging said gear rack and being rotatable by said adjusting knob for shifting on said gear rack.

2. A guide template as defined in claim 1, wherein said plate holds said gear rack and has slotted holes for shifting said gear rack and said second template section.

3. A guide template for a sewing machine to sew workpieces of different form and/or size, said template having a plurality of sections movable relative to one another and comprising: a first template section; a second movable and adjustable template section; a third template section pivotably mounted on said second template section for lengthening said first template section; adjustment means for adjusting said third template section to differnt contours; a machine frame; a gear rack on a plate; said second template section being located between said first template section and said third template section for extending the guide template and being held by said gear rack on said plate on said machine frame; and pinion means with an adjustment knob, said pinion means engaging said gear rack and being rotatable by said adjustment knob for shifting on said gear rack.

4. A guide template as defined in claim 3 wherein said adjustment means has a cam plate interacting with said third template section; and a handwheel, said cam plate being mounted rotatably on said machine frame by said handwheel.

5. A guide template as defined in claim 3 wherein said plate holds said gear rack and has slotted holes for shifting said gear rack and said second template section.

6. A guide template as defined in claim 3 including means having a driven roller for moving along a contour of said template by said driven roller.

* * * * *